US007467926B2

(12) United States Patent
Stampfli et al.

(10) Patent No.: US 7,467,926 B2
(45) Date of Patent: Dec. 23, 2008

(54) STATOR BLADE AIRFOIL PROFILE FOR A COMPRESSOR

(75) Inventors: John David Stampfli, Greer, SC (US); Josef Scott Cummins, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 375 days.

(21) Appl. No.: 11/449,770

(22) Filed: Jun. 9, 2006

(65) Prior Publication Data

US 2007/0286718 A1 Dec. 13, 2007

(51) Int. Cl.
*F01D 9/00* (2006.01)

(52) U.S. Cl. ..... 416/223 A; 416/DIG. 2

(58) Field of Classification Search ..... 416/223 A, 416/223 R, 243, DIG. 2
See application file for complete search history.

(56) References Cited

U.S. PATENT DOCUMENTS

| | | | |
|---|---|---|---|
| 6,398,489 | B1 | 6/2002 | Burdgick et al. |
| 6,450,770 | B1 | 9/2002 | Wang et al. |
| 6,461,109 | B1 | 10/2002 | Wedlake et al. |
| 6,461,110 | B1 | 10/2002 | By et al. |
| 6,474,948 | B1 | 11/2002 | Pirolla et al. |
| 6,503,054 | B1 | 1/2003 | Bielek et al. |
| 6,503,059 | B1 | 1/2003 | Frost et al. |
| 6,558,122 | B1 | 5/2003 | Xu et al. |
| 6,685,434 | B1 | 2/2004 | Humanchuk et al. |
| 6,715,990 | B1 | 4/2004 | Arness et al. |
| 6,722,852 | B1 | 4/2004 | Wedlake et al. |
| 6,722,853 | B1 | 4/2004 | Humanchuk et al. |
| 6,739,838 | B1 | 5/2004 | Bielek et al. |
| 6,769,879 | B1 | 8/2004 | Cleveland et al. |
| 6,779,977 | B2 | 8/2004 | Lagrange et al. |
| 6,779,980 | B1 | 8/2004 | Brittingham et al. |
| 6,808,368 | B1 | 10/2004 | Tomberg et al. |
| 6,832,897 | B2 | 12/2004 | Urban |
| 6,854,961 | B2 | 2/2005 | Zhang et al. |
| 6,857,855 | B1 | 2/2005 | Snook et al. |
| 6,866,477 | B2 | 3/2005 | Arness et al. |
| 6,881,038 | B1 | 4/2005 | Beddard et al. |
| 6,884,038 | B2 | 4/2005 | Hyde et al. |
| 6,910,868 | B2 | 6/2005 | Hyde et al. |
| 6,994,520 | B2 | 2/2006 | Humanchuk |

(Continued)

OTHER PUBLICATIONS

U.S. Appl. No. 11/214,499, filed Aug. 30, 2005, entitled: Stator Vane Profile Optimization.

(Continued)

*Primary Examiner*—Edward Look
*Assistant Examiner*—Nathaniel Wiehe
(74) *Attorney, Agent, or Firm*—Nixon & Vanderhye, PC

(57) ABSTRACT

Tenth stage stator vanes for a compressor comprise airfoil profiles substantially in accordance with Cartesian coordinate values of x, Y and Z set forth in inches in Table I, wherein the Z coordinate values are perpendicular distances from planes normal to a radius from the compressor centerline and containing the X and Y values with the Z value commencing at zero in the X, Y plane at a radial aerodynamic section of the airfoil. X and Y are coordinate values defining the airfoil profile at each distance Z. The X, Y and Z values may be scaled to provide a scaled-up or scaled-down airfoil section for each stator vane.

12 Claims, 6 Drawing Sheets

U.S. PATENT DOCUMENTS

| | | | | |
|---|---|---|---|---|
| 7,001,147 | B1 | 2/2006 | Phillips | |
| 7,329,092 | B2 * | 2/2008 | Keener et al. | 415/191 |
| 7,384,243 | B2 * | 6/2008 | Noshi | 416/223 A |
| 7,396,211 | B2 * | 7/2008 | Tomberg et al. | 416/223 A |
| 2006/0059890 | A1 | 3/2006 | Sassanelli | |
| 2006/0073014 | A1 | 4/2006 | Tomberg | |

OTHER PUBLICATIONS

U.S. Appl. No. 11/340,532, filed Jan. 27, 2006, entitled: Stator Blade Airfoil Profile for a Compressor.

U.S. Appl. No. 11/392,514, filed Mar. 30, 2006, entitled: Stator Blade Airfoil Profile for a Compressor.

* cited by examiner

STATOR BLADE AIRFOIL PROFILE FOR A COMPRESSOR

BACKGROUND OF THE INVENTION

The present invention relates to a compressor for a turbine and particularly relates to a stator blade airfoil profile for the compressor blades, particularly the tenth stage blades.

The hot gas path of a turbine requires compressor airfoil stator blade profiles that meet system requirements of efficiency and loading. The airfoil shape of the compressor stator blades must optimize the interaction between other stages in the compressor, provide for aerodynamic efficiency and optimize aeromechanic life objectives. Accordingly, there is a need for a stator blade airfoil profile which optimizes these objectives.

BRIEF SUMMARY OF THE INVENTION

In a preferred embodiment of the invention, there is provided a stator blade for a compressor having an airfoil, the airfoil having a shape in an envelope within ±0.100 inches in a direction normal to any airfoil surface location wherein the airfoil has an uncoated nominal profile substantially in accordance with Cartesian coordinate values of X, Y and Z set forth in inches in Table I wherein the Z coordinate values are perpendicular distances from planes normal to a radius from the compressor centerline and containing the X and Y values with the Z value commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

In another preferred embodiment of the invention, there is provided a stator blade for a compressor having an airfoil, the airfoil having an uncoated nominal airfoil profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

In a further preferred embodiment of the invention, there is provided a compressor comprising a plurality of stator blades forming a portion of a compressor stage, each of said blades being in the shape of an airfoil within ±0.100 inches in a direction normal to any airfoil surface location wherein the airfoil has an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

In another preferred embodiment of the invention, there is provided a compressor comprising a plurality of stator blades forming a portion of a compressor stage, each of said blades being in the shape of an airfoil within ±0.100 inches in a direction normal to any airfoil surface location wherein the airfoil has an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

In each instance, the compressor airfoil is specifically designed to operate in conjunction with airfoils around it. The individual airfoils receive the air from the upstream blade rows. At this unique inlet condition, the airfoil turns the flow an intended amount to achieve a given pressure rise that maximizes overall compressor efficiency and pressure rise capability. If one airfoil does not operate as intended, the aerodynamic balance of all of the airfoils around it is corrupted and the compressor will not operate as intended.

DETAILED DESCRIPTION OF THE INVENTION

Figure 1:
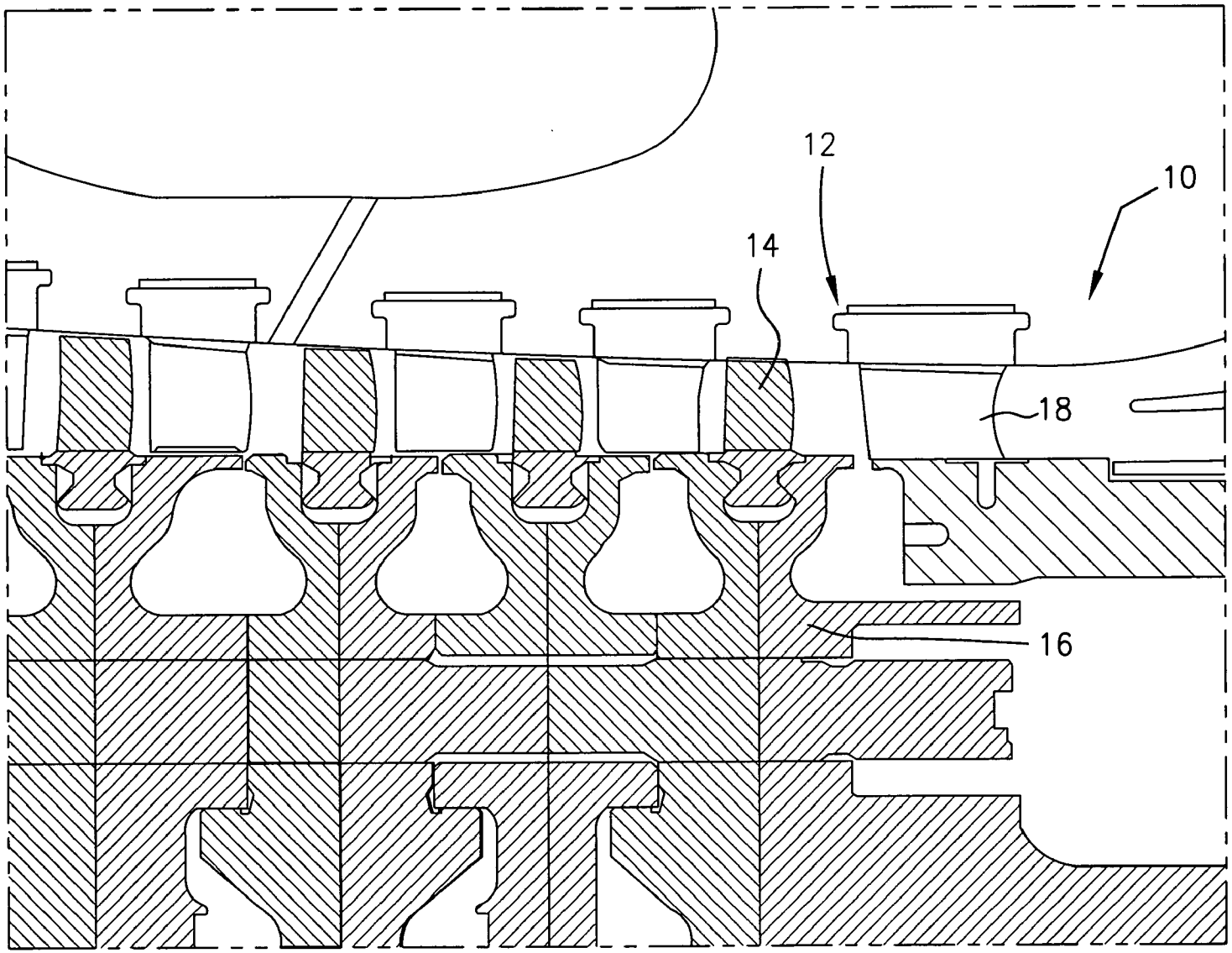
FIG. 1 is a fragmentary cross-sectional view of a compressor illustrating various stages of a compressor including the tenth stage.
Figure 2:
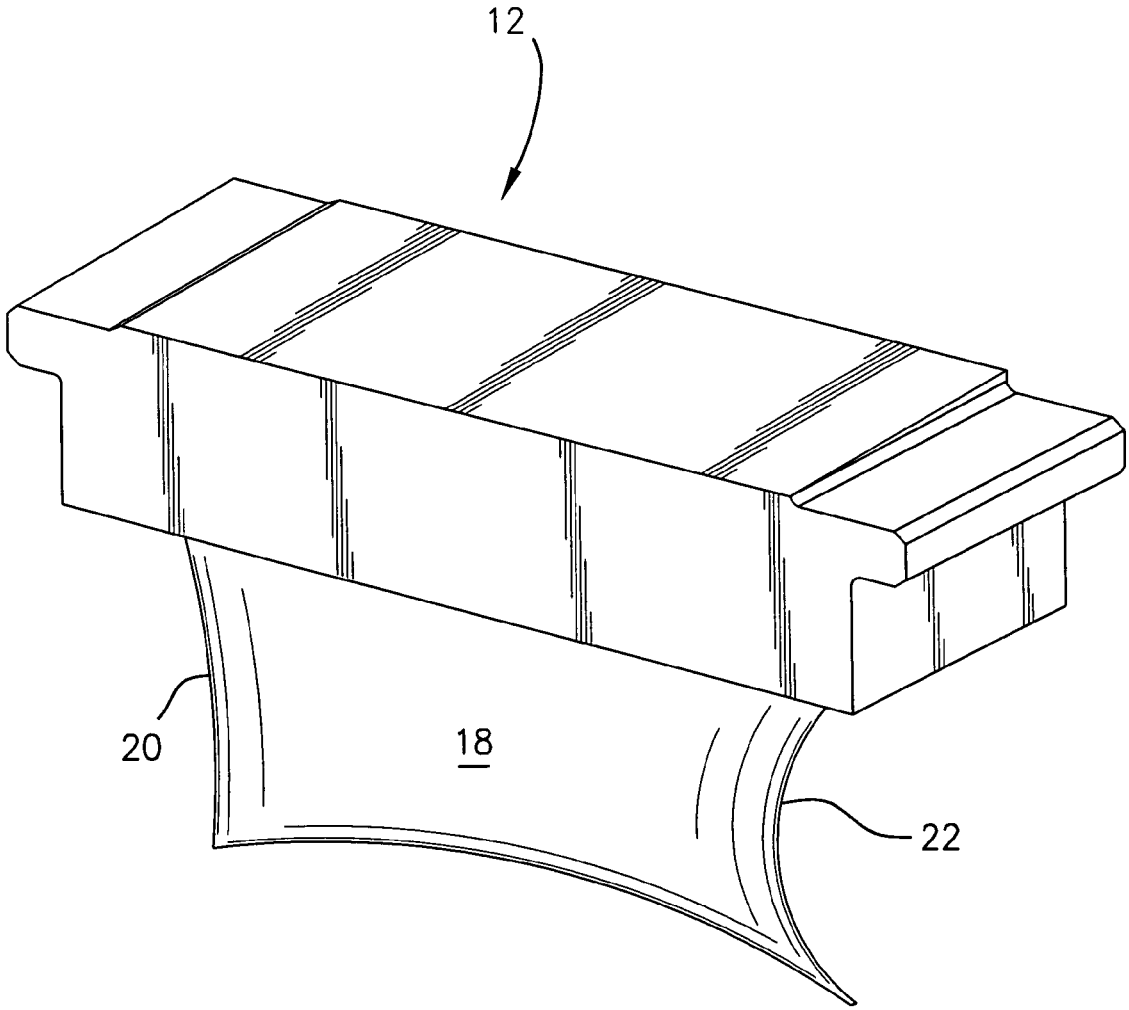
FIG. 2 is perspective view of a blade for the tenth stage of the compressor.
Figure 3:
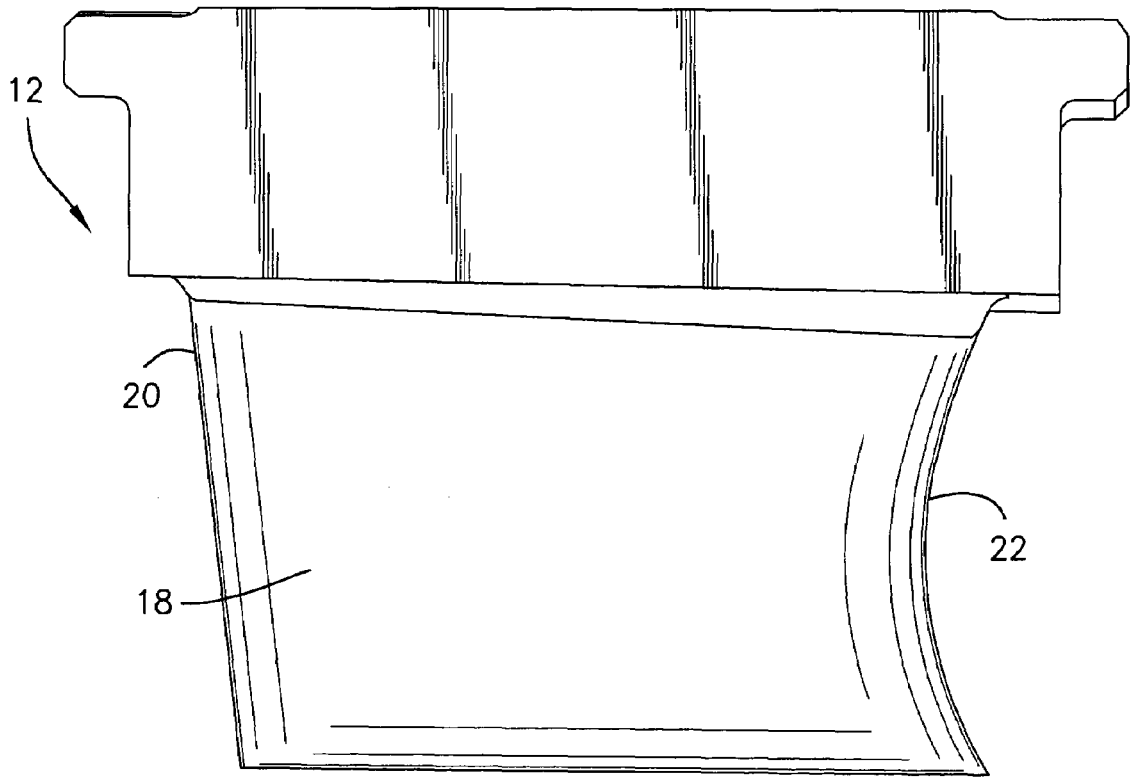
FIG. 3 is a side elevational view thereof.
Figure 4:
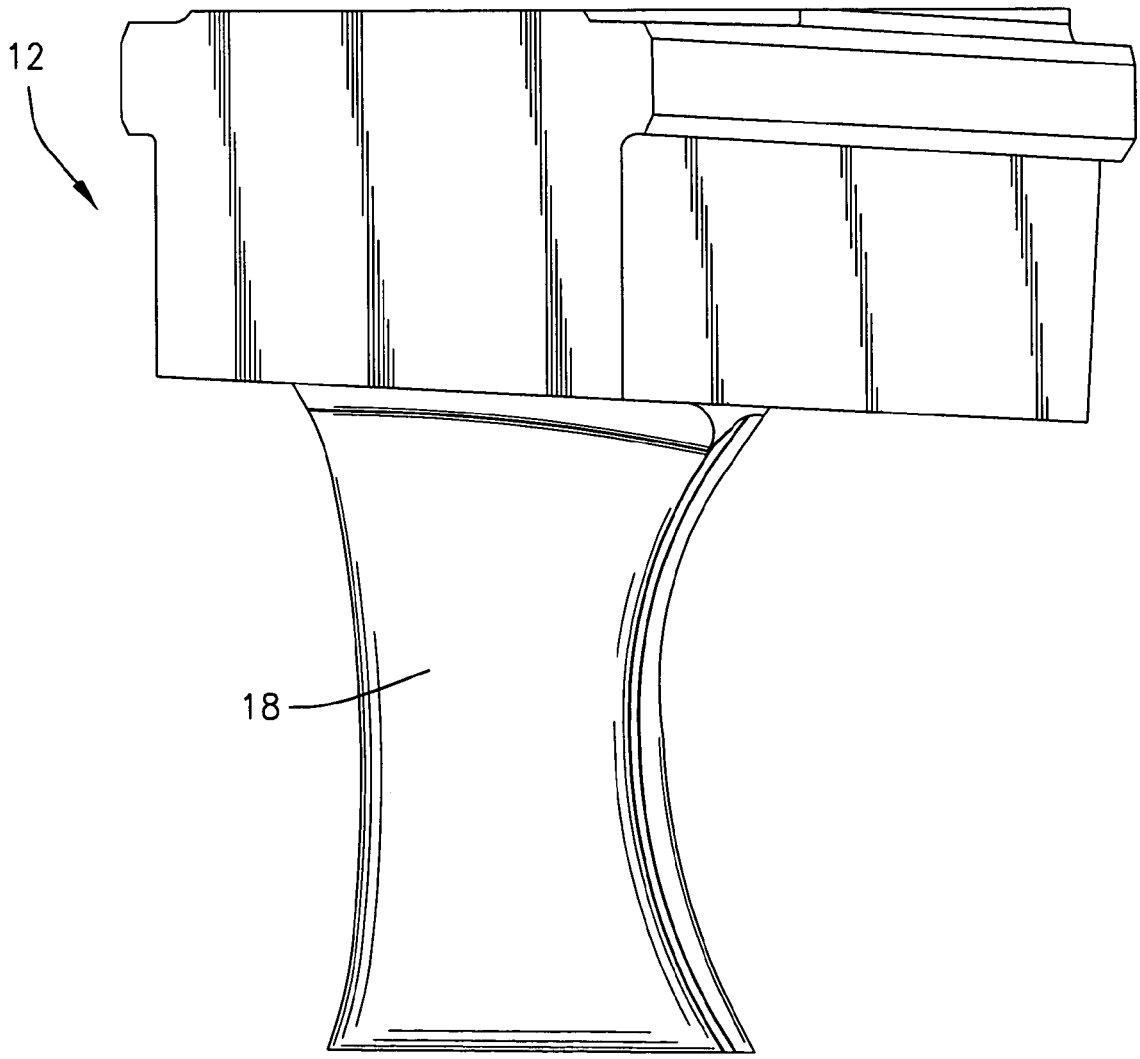
FIG. 4 is a tangential and rear perspective view of the tenth stage compressor blade.
Figure 5:
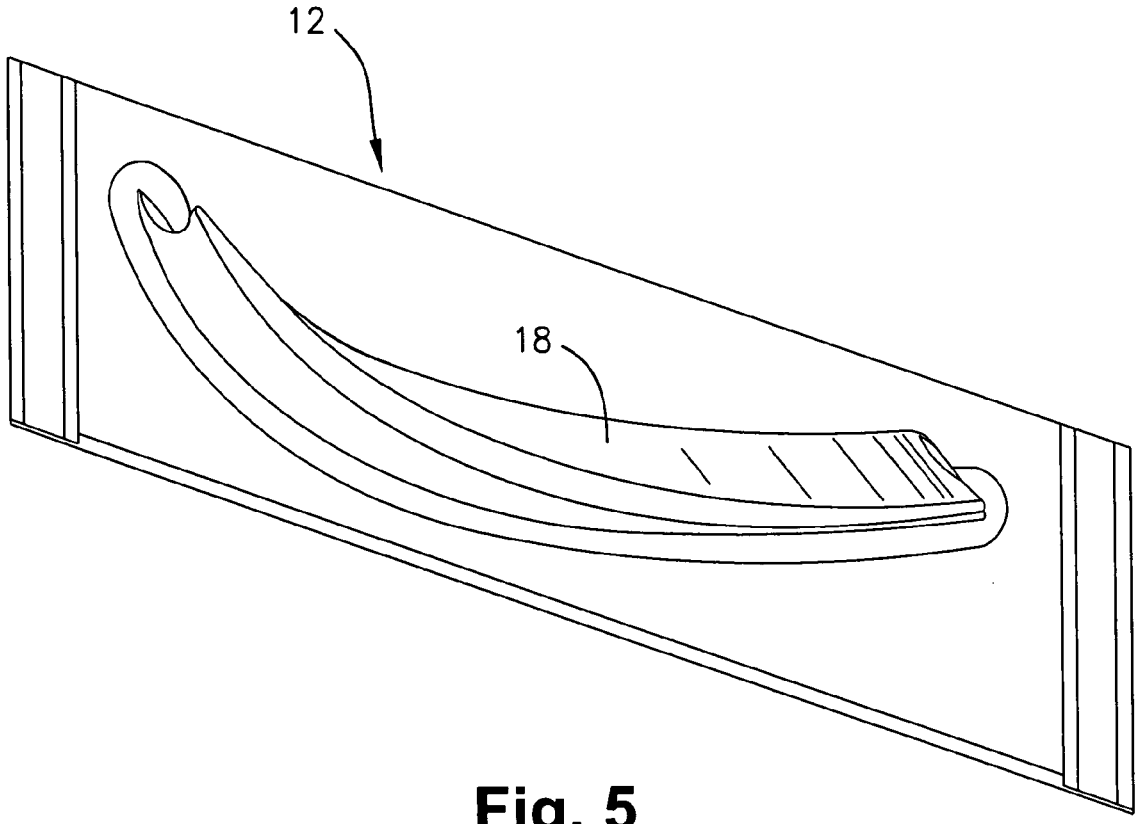
FIG. 5 is a end view of the tenth stage compressor blade as viewed looking radially outwardly from the blade tip.
Figure 6:
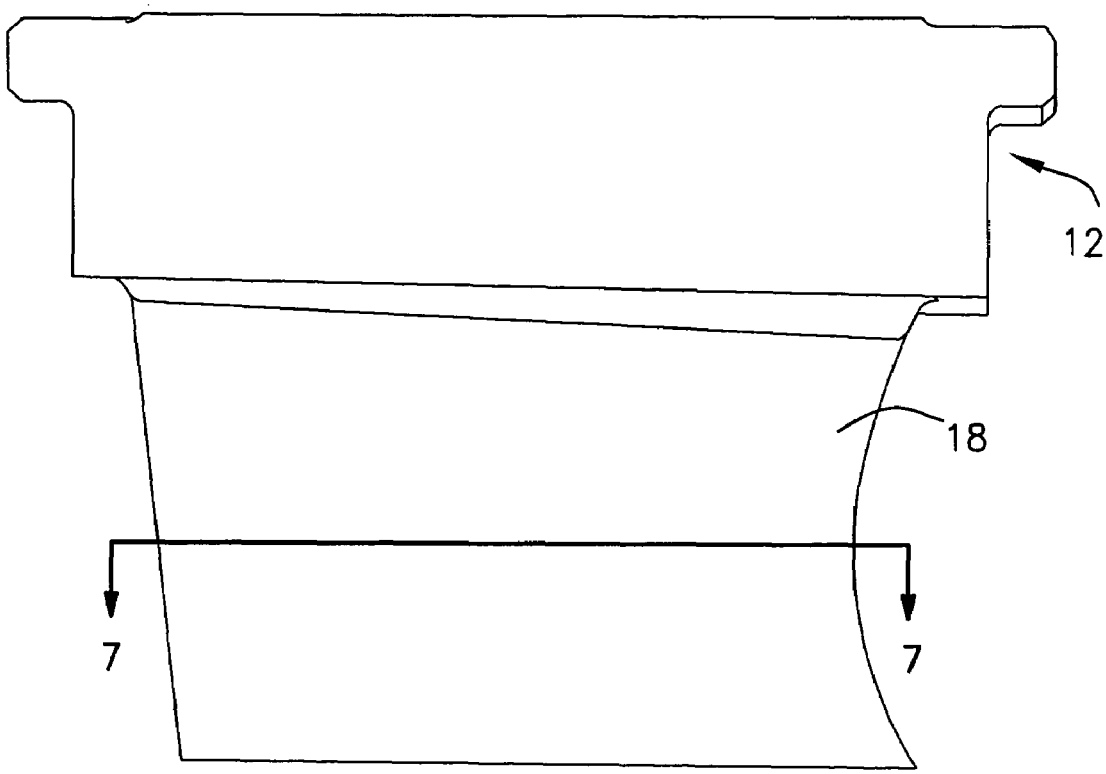
FIG. 6 is a view similar to FIG. 2.
Figure 7:
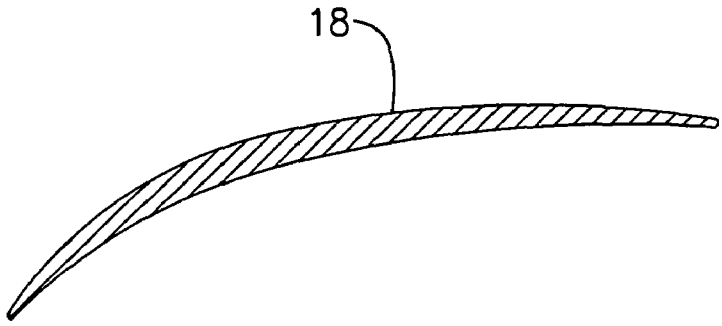
FIG. 7 is a cross-sectional view thereof taken generally about on line 7-7 in FIG. 6.

Referring now to FIG. 1, there is illustrated a portion of a compressor, generally designated 10, having multiple stages including a tenth stage, generally designated 12. Each stage includes a plurality of circumferentially spaced stator blades 13, as well as buckets 14 mounted on the rotor 16. The tenth stage compressor blades 13 are circumferentially spaced one from the other, have airfoils 18 of a particular airfoil shape or profile as specified below. Referring to FIG. 2, the airfoil shape or profile includes leading and trailing edges 20 and 22, respectively. In the preferred and illustrated embodiment of the tenth stage compressor stator vanes, there are 113 vanes forming the tenth stage.

Referring now to FIGS. 2-7, each of the tenth stage stator blades has an airfoil profile defined by a Cartesian coordinate system having X, Y and Z values. The coordinate values are set forth in inches in Table I below. The Cartesian coordinate system includes orthogonally related X, Y and Z axes with the Z axis extending along a radius from the centerline of the compressor rotor, i.e., normal to a plane containing the X and Y values. The Z distance commences at zero in the X, Y plane at the radially outermost aerodynamic blade section. This Z distance, i.e., Z=0, is located on a radius 17.322 inches from the compressor centerline. The X axis lies parallel to the compressor rotor centerline, i.e., the rotary axis. By defining X and Y coordinate values at selected locations in a Z direction normal to the X, Y plane, the profile of airfoil 18 can be ascertained. By connecting the X and Y values with smooth continuing arcs, each profile section at each distance Z is fixed. The surface profiles at the various surface locations between the distances Z are connected smoothly to one another to form the airfoil. The tabular values given in Table I below are in inches and represent airfoil profiles at ambient, non-operating or non-hot conditions and are for an uncoated airfoil. The sign convention assigns a positive value Z in a radially inward direction and positive and negative values for the X and Y coordinate values as typically used in Cartesian coordinate systems.

The 1,232 points are a nominal cold or room-temperature profile for each cross-section of the airfoil.

There are typical manufacturing tolerances, as well as coatings which must be accounted for in the actual profile of the airfoil. Accordingly, the values for the profile given in Table I are for a nominal airfoil. It will therefore be appreciated that typical manufacturing tolerances, i.e., ± values and coating thicknesses are additive to or subtractive from the X, Y values given in Table I below. Accordingly, a distance of ±0.100 inches in a direction normal to any surface location along the airfoil profile, defines an airfoil profile envelope for this particular airfoil design and compressor. In a preferred embodiment, the vane airfoil profiles given in Table I below are for the tenth stage blades of the compressor.

The coordinate values given in Table I below are in inches and provide the preferred nominal profile envelope.

TABLE I

| X-LOC | Y-LOC | Z-LOC | X-LOC | Y-LOC | Z-LOC | X-LOC | Y-LOC | Z-LOC |
|---|---|---|---|---|---|---|---|---|
| 0.960 | −0.767 | 0.000 | −0.437 | 0.066 | 0.000 | −0.193 | −0.013 | 0.000 |
| 0.960 | −0.768 | 0.000 | −0.462 | 0.109 | 0.000 | −0.151 | −0.052 | 0.000 |
| 0.959 | −0.769 | 0.000 | −0.484 | 0.151 | 0.000 | −0.107 | −0.091 | 0.000 |
| 0.957 | −0.772 | 0.000 | −0.502 | 0.191 | 0.000 | −0.063 | −0.130 | 0.000 |
| 0.953 | −0.775 | 0.000 | −0.517 | 0.227 | 0.000 | −0.018 | −0.169 | 0.000 |
| 0.944 | −0.777 | 0.000 | −0.529 | 0.260 | 0.000 | 0.027 | −0.206 | 0.000 |
| 0.932 | −0.773 | 0.000 | −0.539 | 0.290 | 0.000 | 0.073 | −0.243 | 0.000 |
| 0.916 | −0.769 | 0.000 | −0.546 | 0.316 | 0.000 | 0.119 | −0.279 | 0.000 |
| 0.896 | −0.764 | 0.000 | −0.552 | 0.338 | 0.000 | 0.166 | −0.315 | 0.000 |
| 0.870 | −0.756 | 0.000 | −0.557 | 0.357 | 0.000 | 0.214 | −0.349 | 0.000 |
| 0.840 | −0.748 | 0.000 | −0.560 | 0.373 | 0.000 | 0.262 | −0.383 | 0.000 |
| 0.808 | −0.740 | 0.000 | −0.562 | 0.387 | 0.000 | 0.311 | −0.416 | 0.000 |
| 0.772 | −0.730 | 0.000 | −0.563 | 0.397 | 0.000 | 0.360 | −0.448 | 0.000 |
| 0.731 | −0.719 | 0.000 | −0.563 | 0.406 | 0.000 | 0.410 | −0.479 | 0.000 |
| 0.688 | −0.707 | 0.000 | −0.562 | 0.412 | 0.000 | 0.459 | −0.508 | 0.000 |
| 0.642 | −0.694 | 0.000 | −0.561 | 0.417 | 0.000 | 0.506 | −0.536 | 0.000 |
| 0.594 | −0.679 | 0.000 | −0.559 | 0.421 | 0.000 | 0.552 | −0.562 | 0.000 |
| 0.545 | −0.663 | 0.000 | −0.556 | 0.423 | 0.000 | 0.597 | −0.586 | 0.000 |
| 0.494 | −0.645 | 0.000 | −0.553 | 0.423 | 0.000 | 0.641 | −0.609 | 0.000 |
| 0.441 | −0.626 | 0.000 | −0.550 | 0.422 | 0.000 | 0.683 | −0.630 | 0.000 |
| 0.387 | −0.605 | 0.000 | −0.546 | 0.419 | 0.000 | 0.723 | −0.650 | 0.000 |
| 0.332 | −0.581 | 0.000 | −0.542 | 0.415 | 0.000 | 0.762 | −0.669 | 0.000 |
| 0.275 | −0.555 | 0.000 | −0.536 | 0.409 | 0.000 | 0.798 | −0.685 | 0.000 |
| 0.220 | −0.527 | 0.000 | −0.530 | 0.401 | 0.000 | 0.830 | −0.700 | 0.000 |
| 0.165 | −0.497 | 0.000 | −0.523 | 0.390 | 0.000 | 0.859 | −0.712 | 0.000 |
| 0.112 | −0.466 | 0.000 | −0.515 | 0.377 | 0.000 | 0.886 | −0.724 | 0.000 |
| 0.060 | −0.433 | 0.000 | −0.505 | 0.361 | 0.000 | 0.910 | −0.733 | 0.000 |
| 0.009 | −0.398 | 0.000 | −0.494 | 0.343 | 0.000 | 0.928 | −0.740 | 0.000 |
| −0.040 | −0.362 | 0.000 | −0.481 | 0.321 | 0.000 | 0.943 | −0.745 | 0.000 |
| −0.089 | −0.324 | 0.000 | −0.465 | 0.296 | 0.000 | 0.954 | −0.750 | 0.000 |
| −0.136 | −0.285 | 0.000 | −0.446 | 0.268 | 0.000 | 0.960 | −0.756 | 0.000 |
| −0.182 | −0.244 | 0.000 | −0.424 | 0.238 | 0.000 | 0.961 | −0.761 | 0.000 |
| −0.227 | −0.201 | 0.000 | −0.399 | 0.206 | 0.000 | 0.961 | −0.764 | 0.000 |
| −0.270 | −0.156 | 0.000 | −0.370 | 0.171 | 0.000 | 0.961 | −0.766 | 0.000 |
| −0.310 | −0.111 | 0.000 | −0.338 | 0.135 | 0.000 | 0.961 | −0.766 | 0.000 |
| −0.346 | −0.066 | 0.000 | −0.305 | 0.099 | 0.000 | 0.960 | −0.767 | 0.000 |
| −0.380 | −0.022 | 0.000 | −0.270 | 0.062 | 0.000 | | | |
| −0.410 | 0.022 | 0.000 | −0.232 | 0.025 | 0.000 | | | |
| 0.977 | −0.729 | 0.099 | −0.415 | 0.060 | 0.099 | −0.180 | −0.012 | 0.099 |
| 0.977 | −0.730 | 0.099 | −0.443 | 0.100 | 0.099 | −0.137 | −0.048 | 0.099 |
| 0.976 | −0.732 | 0.099 | −0.468 | 0.139 | 0.099 | −0.092 | −0.085 | 0.099 |
| 0.974 | −0.734 | 0.099 | −0.490 | 0.176 | 0.099 | −0.047 | −0.121 | 0.099 |
| 0.970 | −0.737 | 0.099 | −0.507 | 0.210 | 0.099 | −0.001 | −0.157 | 0.099 |
| 0.961 | −0.739 | 0.099 | −0.522 | 0.241 | 0.099 | 0.045 | −0.192 | 0.099 |
| 0.949 | −0.735 | 0.099 | −0.534 | 0.269 | 0.099 | 0.092 | −0.226 | 0.099 |
| 0.934 | −0.730 | 0.099 | −0.544 | 0.293 | 0.099 | 0.140 | −0.259 | 0.099 |
| 0.914 | −0.725 | 0.099 | −0.551 | 0.314 | 0.099 | 0.188 | −0.292 | 0.099 |
| 0.889 | −0.717 | 0.099 | −0.557 | 0.333 | 0.099 | 0.236 | −0.324 | 0.099 |
| 0.860 | −0.708 | 0.099 | −0.562 | 0.348 | 0.099 | 0.285 | −0.356 | 0.099 |
| 0.829 | −0.699 | 0.099 | −0.565 | 0.361 | 0.099 | 0.334 | −0.387 | 0.099 |
| 0.794 | −0.689 | 0.099 | −0.567 | 0.371 | 0.099 | 0.383 | −0.417 | 0.099 |
| 0.756 | −0.677 | 0.099 | −0.568 | 0.379 | 0.099 | 0.433 | −0.447 | 0.099 |
| 0.713 | −0.664 | 0.099 | −0.568 | 0.386 | 0.099 | 0.482 | −0.475 | 0.099 |
| 0.669 | −0.649 | 0.099 | −0.568 | 0.391 | 0.099 | 0.529 | −0.501 | 0.099 |
| 0.623 | −0.634 | 0.099 | −0.566 | 0.394 | 0.099 | 0.575 | −0.526 | 0.099 |
| 0.575 | −0.617 | 0.099 | −0.563 | 0.396 | 0.099 | 0.619 | −0.550 | 0.099 |
| 0.526 | −0.599 | 0.099 | −0.560 | 0.397 | 0.099 | 0.662 | −0.572 | 0.099 |
| 0.475 | −0.579 | 0.099 | −0.557 | 0.396 | 0.099 | 0.704 | −0.593 | 0.099 |

TABLE I-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.423 | −0.558 | 0.099 | −0.553 | 0.393 | 0.099 | 0.744 | −0.612 | 0.099 |
| 0.369 | −0.534 | 0.099 | −0.548 | 0.390 | 0.099 | 0.782 | −0.631 | 0.099 |
| 0.314 | −0.509 | 0.099 | −0.543 | 0.384 | 0.099 | 0.817 | −0.647 | 0.099 |
| 0.260 | −0.483 | 0.099 | −0.537 | 0.376 | 0.099 | 0.849 | −0.661 | 0.099 |
| 0.207 | −0.455 | 0.099 | −0.529 | 0.366 | 0.099 | 0.878 | −0.674 | 0.099 |
| 0.155 | −0.426 | 0.099 | −0.520 | 0.354 | 0.099 | 0.904 | −0.685 | 0.099 |
| 0.103 | −0.396 | 0.099 | −0.509 | 0.339 | 0.099 | 0.928 | −0.695 | 0.099 |
| 0.052 | −0.364 | 0.099 | −0.497 | 0.321 | 0.099 | 0.946 | −0.702 | 0.099 |
| 0.002 | −0.331 | 0.099 | −0.482 | 0.301 | 0.099 | 0.960 | −0.707 | 0.099 |
| −0.048 | −0.296 | 0.099 | −0.465 | 0.278 | 0.099 | 0.971 | −0.712 | 0.099 |
| −0.097 | −0.261 | 0.099 | −0.444 | 0.252 | 0.099 | 0.977 | −0.718 | 0.099 |
| −0.144 | −0.223 | 0.099 | −0.421 | 0.224 | 0.099 | 0.978 | −0.723 | 0.099 |
| −0.191 | −0.184 | 0.099 | −0.394 | 0.193 | 0.099 | 0.978 | −0.726 | 0.099 |
| −0.236 | −0.143 | 0.099 | −0.363 | 0.161 | 0.099 | 0.977 | −0.728 | 0.099 |
| −0.277 | −0.103 | 0.099 | −0.331 | 0.127 | 0.099 | 0.977 | −0.728 | 0.099 |
| −0.316 | −0.062 | 0.099 | −0.296 | 0.093 | 0.099 | 0.977 | −0.729 | 0.099 |
| −0.352 | −0.021 | 0.099 | −0.260 | 0.059 | 0.099 | | | |
| −0.385 | 0.019 | 0.099 | −0.221 | 0.024 | 0.099 | | | |
| 0.995 | −0.582 | 0.369 | −0.369 | 0.133 | 0.369 | −0.159 | 0.066 | 0.369 |
| 0.994 | −0.582 | 0.369 | −0.401 | 0.167 | 0.369 | −0.115 | 0.033 | 0.369 |
| 0.994 | −0.584 | 0.369 | −0.430 | 0.200 | 0.369 | −0.069 | 0.000 | 0.369 |
| 0.992 | −0.586 | 0.369 | −0.456 | 0.232 | 0.369 | −0.023 | −0.032 | 0.369 |
| 0.988 | −0.589 | 0.369 | −0.479 | 0.261 | 0.369 | 0.023 | −0.064 | 0.369 |
| 0.979 | −0.591 | 0.369 | −0.498 | 0.287 | 0.369 | 0.070 | −0.095 | 0.369 |
| 0.968 | −0.588 | 0.369 | −0.515 | 0.311 | 0.369 | 0.117 | −0.126 | 0.369 |
| 0.954 | −0.583 | 0.369 | −0.529 | 0.332 | 0.369 | 0.165 | −0.156 | 0.369 |
| 0.935 | −0.577 | 0.369 | −0.540 | 0.350 | 0.369 | 0.214 | −0.185 | 0.369 |
| 0.912 | −0.569 | 0.369 | −0.549 | 0.365 | 0.369 | 0.262 | −0.213 | 0.369 |
| 0.884 | −0.560 | 0.369 | −0.557 | 0.379 | 0.369 | 0.311 | −0.241 | 0.369 |
| 0.855 | −0.550 | 0.369 | −0.563 | 0.390 | 0.369 | 0.360 | −0.269 | 0.369 |
| 0.822 | −0.539 | 0.369 | −0.567 | 0.399 | 0.369 | 0.410 | −0.296 | 0.369 |
| 0.786 | −0.527 | 0.369 | −0.570 | 0.406 | 0.369 | 0.459 | −0.322 | 0.369 |
| 0.746 | −0.513 | 0.369 | −0.572 | 0.411 | 0.369 | 0.508 | −0.347 | 0.369 |
| 0.704 | −0.498 | 0.369 | −0.572 | 0.416 | 0.369 | 0.555 | −0.371 | 0.369 |
| 0.661 | −0.482 | 0.369 | −0.572 | 0.420 | 0.369 | 0.600 | −0.394 | 0.369 |
| 0.616 | −0.465 | 0.369 | −0.570 | 0.422 | 0.369 | 0.644 | −0.415 | 0.369 |
| 0.569 | −0.446 | 0.369 | −0.567 | 0.423 | 0.369 | 0.686 | −0.436 | 0.369 |
| 0.521 | −0.427 | 0.369 | −0.563 | 0.423 | 0.369 | 0.727 | −0.455 | 0.369 |
| 0.471 | −0.406 | 0.369 | −0.559 | 0.421 | 0.369 | 0.767 | −0.473 | 0.369 |
| 0.420 | −0.384 | 0.369 | −0.554 | 0.418 | 0.369 | 0.804 | −0.490 | 0.369 |
| 0.367 | −0.361 | 0.369 | −0.549 | 0.413 | 0.369 | 0.839 | −0.505 | 0.369 |
| 0.315 | −0.336 | 0.369 | −0.542 | 0.406 | 0.369 | 0.870 | −0.518 | 0.369 |
| 0.263 | −0.311 | 0.369 | −0.533 | 0.398 | 0.369 | 0.898 | −0.529 | 0.369 |
| 0.211 | −0.285 | 0.369 | −0.522 | 0.387 | 0.369 | 0.924 | −0.540 | 0.369 |
| 0.160 | −0.258 | 0.369 | −0.510 | 0.374 | 0.369 | 0.947 | −0.548 | 0.369 |
| 0.110 | −0.230 | 0.369 | −0.496 | 0.360 | 0.369 | 0.964 | −0.555 | 0.369 |
| 0.060 | −0.201 | 0.369 | −0.478 | 0.342 | 0.369 | 0.979 | −0.560 | 0.369 |
| 0.011 | −0.171 | 0.369 | −0.458 | 0.322 | 0.369 | 0.989 | −0.564 | 0.369 |
| −0.037 | −0.140 | 0.369 | −0.435 | 0.300 | 0.369 | 0.994 | −0.571 | 0.369 |
| −0.085 | −0.107 | 0.369 | −0.409 | 0.276 | 0.369 | 0.995 | −0.576 | 0.369 |
| −0.131 | −0.074 | 0.369 | −0.380 | 0.249 | 0.369 | 0.995 | −0.579 | 0.369 |
| −0.177 | −0.040 | 0.369 | −0.348 | 0.220 | 0.369 | 0.995 | −0.580 | 0.369 |
| −0.220 | −0.005 | 0.369 | −0.314 | 0.190 | 0.369 | 0.995 | −0.581 | 0.369 |
| −0.261 | 0.030 | 0.369 | −0.278 | 0.160 | 0.369 | 0.995 | −0.581 | 0.369 |
| −0.299 | 0.064 | 0.369 | −0.240 | 0.129 | 0.369 | | | |
| −0.335 | 0.099 | 0.369 | −0.200 | 0.098 | 0.369 | | | |
| 1.011 | −0.505 | 0.539 | −0.354 | 0.189 | 0.539 | −0.143 | 0.126 | 0.539 |
| 1.010 | −0.506 | 0.539 | −0.386 | 0.221 | 0.539 | −0.099 | 0.095 | 0.539 |
| 1.010 | −0.507 | 0.539 | −0.416 | 0.253 | 0.539 | −0.053 | 0.062 | 0.539 |
| 1.008 | −0.510 | 0.539 | −0.443 | 0.283 | 0.539 | −0.007 | 0.030 | 0.539 |
| 1.004 | −0.513 | 0.539 | −0.467 | 0.311 | 0.539 | 0.040 | −0.001 | 0.539 |
| 0.996 | −0.514 | 0.539 | −0.487 | 0.336 | 0.539 | 0.087 | −0.031 | 0.539 |
| 0.985 | −0.511 | 0.539 | −0.505 | 0.359 | 0.539 | 0.134 | −0.061 | 0.539 |
| 0.970 | −0.507 | 0.539 | −0.520 | 0.379 | 0.539 | 0.182 | −0.090 | 0.539 |
| 0.952 | −0.501 | 0.539 | −0.532 | 0.396 | 0.539 | 0.230 | −0.119 | 0.539 |
| 0.928 | −0.494 | 0.539 | −0.542 | 0.411 | 0.539 | 0.278 | −0.147 | 0.539 |
| 0.901 | −0.485 | 0.539 | −0.550 | 0.424 | 0.539 | 0.327 | −0.174 | 0.539 |
| 0.872 | −0.476 | 0.539 | −0.557 | 0.435 | 0.539 | 0.376 | −0.201 | 0.539 |
| 0.839 | −0.465 | 0.539 | −0.562 | 0.443 | 0.539 | 0.425 | −0.227 | 0.539 |
| 0.802 | −0.453 | 0.539 | −0.565 | 0.450 | 0.539 | 0.475 | −0.253 | 0.539 |
| 0.762 | −0.440 | 0.539 | −0.567 | 0.456 | 0.539 | 0.523 | −0.278 | 0.539 |
| 0.721 | −0.426 | 0.539 | −0.568 | 0.460 | 0.539 | 0.570 | −0.301 | 0.539 |
| 0.678 | −0.410 | 0.539 | −0.567 | 0.464 | 0.539 | 0.615 | −0.323 | 0.539 |
| 0.633 | −0.394 | 0.539 | −0.566 | 0.467 | 0.539 | 0.659 | −0.344 | 0.539 |
| 0.586 | −0.376 | 0.539 | −0.563 | 0.468 | 0.539 | 0.702 | −0.364 | 0.539 |
| 0.538 | −0.357 | 0.539 | −0.559 | 0.468 | 0.539 | 0.743 | −0.382 | 0.539 |
| 0.488 | −0.337 | 0.539 | −0.555 | 0.466 | 0.539 | 0.782 | −0.400 | 0.539 |

TABLE I-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.437 | −0.315 | 0.539 | −0.550 | 0.463 | 0.539 | 0.820 | −0.416 | 0.539 |
| 0.385 | −0.292 | 0.539 | −0.544 | 0.459 | 0.539 | 0.854 | −0.431 | 0.539 |
| 0.333 | −0.269 | 0.539 | −0.537 | 0.452 | 0.539 | 0.886 | −0.443 | 0.539 |
| 0.281 | −0.244 | 0.539 | −0.527 | 0.444 | 0.539 | 0.914 | −0.454 | 0.539 |
| 0.229 | −0.218 | 0.539 | −0.516 | 0.434 | 0.539 | 0.940 | −0.464 | 0.539 |
| 0.178 | −0.192 | 0.539 | −0.503 | 0.423 | 0.539 | 0.963 | −0.473 | 0.539 |
| 0.128 | −0.165 | 0.539 | −0.488 | 0.409 | 0.539 | 0.980 | −0.479 | 0.539 |
| 0.078 | −0.136 | 0.539 | −0.470 | 0.392 | 0.539 | 0.994 | −0.484 | 0.539 |
| 0.029 | −0.107 | 0.539 | −0.449 | 0.374 | 0.539 | 1.005 | −0.488 | 0.539 |
| −0.019 | −0.076 | 0.539 | −0.425 | 0.353 | 0.539 | 1.010 | −0.494 | 0.539 |
| −0.067 | −0.045 | 0.539 | −0.398 | 0.329 | 0.539 | 1.011 | −0.499 | 0.539 |
| −0.114 | −0.012 | 0.539 | −0.368 | 0.304 | 0.539 | 1.011 | −0.502 | 0.539 |
| −0.160 | 0.022 | 0.539 | −0.335 | 0.276 | 0.539 | 1.011 | −0.503 | 0.539 |
| −0.203 | 0.056 | 0.539 | −0.301 | 0.247 | 0.539 | 1.011 | −0.504 | 0.539 |
| −0.244 | 0.089 | 0.539 | −0.264 | 0.218 | 0.539 | 1.011 | −0.505 | 0.539 |
| −0.283 | 0.123 | 0.539 | −0.226 | 0.188 | 0.539 | | | |
| −0.320 | 0.156 | 0.539 | −0.185 | 0.158 | 0.539 | | | |
| 1.019 | −0.477 | 0.625 | −0.348 | 0.213 | 0.625 | −0.138 | 0.152 | 0.625 |
| 1.019 | −0.478 | 0.625 | −0.380 | 0.246 | 0.625 | −0.093 | 0.120 | 0.625 |
| 1.018 | −0.479 | 0.625 | −0.411 | 0.277 | 0.625 | −0.048 | 0.088 | 0.625 |
| 1.016 | −0.482 | 0.625 | −0.438 | 0.307 | 0.625 | −0.001 | 0.056 | 0.625 |
| 1.012 | −0.485 | 0.625 | −0.462 | 0.334 | 0.625 | 0.045 | 0.025 | 0.625 |
| 1.004 | −0.486 | 0.625 | −0.483 | 0.359 | 0.625 | 0.092 | −0.006 | 0.625 |
| 0.993 | −0.483 | 0.625 | −0.501 | 0.382 | 0.625 | 0.140 | −0.036 | 0.625 |
| 0.978 | −0.479 | 0.625 | −0.516 | 0.401 | 0.625 | 0.188 | −0.065 | 0.625 |
| 0.960 | −0.473 | 0.625 | −0.529 | 0.418 | 0.625 | 0.236 | −0.093 | 0.625 |
| 0.936 | −0.466 | 0.625 | −0.539 | 0.433 | 0.625 | 0.284 | −0.121 | 0.625 |
| 0.909 | −0.458 | 0.625 | −0.548 | 0.446 | 0.625 | 0.333 | −0.149 | 0.625 |
| 0.879 | −0.449 | 0.625 | −0.554 | 0.456 | 0.625 | 0.382 | −0.176 | 0.625 |
| 0.847 | −0.438 | 0.625 | −0.559 | 0.465 | 0.625 | 0.432 | −0.202 | 0.625 |
| 0.810 | −0.427 | 0.625 | −0.563 | 0.472 | 0.625 | 0.481 | −0.228 | 0.625 |
| 0.770 | −0.413 | 0.625 | −0.565 | 0.477 | 0.625 | 0.530 | −0.252 | 0.625 |
| 0.728 | −0.399 | 0.625 | −0.566 | 0.482 | 0.625 | 0.577 | −0.276 | 0.625 |
| 0.685 | −0.384 | 0.625 | −0.566 | 0.486 | 0.625 | 0.622 | −0.297 | 0.625 |
| 0.640 | −0.368 | 0.625 | −0.564 | 0.488 | 0.625 | 0.666 | −0.318 | 0.625 |
| 0.594 | −0.350 | 0.625 | −0.561 | 0.489 | 0.625 | 0.709 | −0.338 | 0.625 |
| 0.545 | −0.331 | 0.625 | −0.558 | 0.489 | 0.625 | 0.750 | −0.356 | 0.625 |
| 0.496 | −0.311 | 0.625 | −0.553 | 0.487 | 0.625 | 0.789 | −0.373 | 0.625 |
| 0.444 | −0.290 | 0.625 | −0.549 | 0.485 | 0.625 | 0.827 | −0.389 | 0.625 |
| 0.392 | −0.267 | 0.625 | −0.542 | 0.480 | 0.625 | 0.862 | −0.404 | 0.625 |
| 0.340 | −0.243 | 0.625 | −0.535 | 0.474 | 0.625 | 0.893 | −0.416 | 0.625 |
| 0.288 | −0.219 | 0.625 | −0.525 | 0.467 | 0.625 | 0.921 | −0.427 | 0.625 |
| 0.236 | −0.193 | 0.625 | −0.514 | 0.457 | 0.625 | 0.948 | −0.437 | 0.625 |
| 0.185 | −0.167 | 0.625 | −0.501 | 0.445 | 0.625 | 0.971 | −0.445 | 0.625 |
| 0.135 | −0.139 | 0.625 | −0.485 | 0.432 | 0.625 | 0.988 | −0.451 | 0.625 |
| 0.085 | −0.111 | 0.625 | −0.467 | 0.416 | 0.625 | 1.002 | −0.456 | 0.625 |
| 0.036 | −0.081 | 0.625 | −0.446 | 0.397 | 0.625 | 1.013 | −0.460 | 0.625 |
| −0.012 | −0.051 | 0.625 | −0.421 | 0.376 | 0.625 | 1.018 | −0.466 | 0.625 |
| −0.060 | −0.019 | 0.625 | −0.394 | 0.353 | 0.625 | 1.020 | −0.471 | 0.625 |
| −0.107 | 0.013 | 0.625 | −0.364 | 0.328 | 0.625 | 1.019 | −0.474 | 0.625 |
| −0.153 | 0.047 | 0.625 | −0.331 | 0.301 | 0.625 | 1.019 | −0.475 | 0.625 |
| −0.197 | 0.081 | 0.625 | −0.296 | 0.272 | 0.625 | 1.019 | −0.476 | 0.625 |
| −0.238 | 0.114 | 0.625 | −0.259 | 0.243 | 0.625 | 1.019 | −0.477 | 0.625 |
| −0.277 | 0.148 | 0.625 | −0.220 | 0.214 | 0.625 | | | |
| −0.313 | 0.181 | 0.625 | −0.180 | 0.183 | 0.625 | | | |
| 1.020 | −0.437 | 0.880 | −0.341 | 0.247 | 0.880 | −0.134 | 0.186 | 0.880 |
| 1.020 | −0.437 | 0.880 | −0.374 | 0.279 | 0.880 | −0.090 | 0.154 | 0.880 |
| 1.019 | −0.439 | 0.880 | −0.404 | 0.311 | 0.880 | −0.045 | 0.121 | 0.880 |
| 1.018 | −0.441 | 0.880 | −0.432 | 0.340 | 0.880 | 0.001 | 0.089 | 0.880 |
| 1.014 | −0.445 | 0.880 | −0.456 | 0.367 | 0.880 | 0.047 | 0.057 | 0.880 |
| 1.006 | −0.447 | 0.880 | −0.477 | 0.392 | 0.880 | 0.094 | 0.026 | 0.880 |
| 0.995 | −0.444 | 0.880 | −0.495 | 0.414 | 0.880 | 0.141 | −0.004 | 0.880 |
| 0.980 | −0.440 | 0.880 | −0.510 | 0.433 | 0.880 | 0.188 | −0.034 | 0.880 |
| 0.962 | −0.435 | 0.880 | −0.523 | 0.450 | 0.880 | 0.236 | −0.063 | 0.880 |
| 0.938 | −0.428 | 0.880 | −0.534 | 0.464 | 0.880 | 0.284 | −0.091 | 0.880 |
| 0.910 | −0.421 | 0.880 | −0.542 | 0.477 | 0.880 | 0.333 | −0.119 | 0.880 |
| 0.881 | −0.412 | 0.880 | −0.549 | 0.487 | 0.880 | 0.382 | −0.146 | 0.880 |
| 0.848 | −0.403 | 0.880 | −0.554 | 0.496 | 0.880 | 0.431 | −0.172 | 0.880 |
| 0.811 | −0.392 | 0.880 | −0.558 | 0.502 | 0.880 | 0.481 | −0.198 | 0.880 |
| 0.771 | −0.379 | 0.880 | −0.560 | 0.508 | 0.880 | 0.529 | −0.222 | 0.880 |
| 0.730 | −0.366 | 0.880 | −0.562 | 0.512 | 0.880 | 0.576 | −0.244 | 0.880 |
| 0.686 | −0.352 | 0.880 | −0.561 | 0.516 | 0.880 | 0.622 | −0.266 | 0.880 |
| 0.641 | −0.336 | 0.880 | −0.560 | 0.519 | 0.880 | 0.666 | −0.286 | 0.880 |
| 0.595 | −0.319 | 0.880 | −0.557 | 0.520 | 0.880 | 0.708 | −0.305 | 0.880 |
| 0.546 | −0.301 | 0.880 | −0.554 | 0.520 | 0.880 | 0.750 | −0.322 | 0.880 |
| 0.497 | −0.282 | 0.880 | −0.549 | 0.518 | 0.880 | 0.789 | −0.339 | 0.880 |
| 0.446 | −0.261 | 0.880 | −0.544 | 0.515 | 0.880 | 0.827 | −0.354 | 0.880 |

TABLE I-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.393 | −0.238 | 0.880 | −0.538 | 0.511 | 0.880 | 0.862 | −0.367 | 0.880 |
| 0.341 | −0.214 | 0.880 | −0.530 | 0.505 | 0.880 | 0.894 | −0.379 | 0.880 |
| 0.290 | −0.190 | 0.880 | −0.521 | 0.498 | 0.880 | 0.922 | −0.389 | 0.880 |
| 0.238 | −0.164 | 0.880 | −0.509 | 0.488 | 0.880 | 0.948 | −0.399 | 0.880 |
| 0.188 | −0.138 | 0.880 | −0.496 | 0.477 | 0.880 | 0.971 | −0.406 | 0.880 |
| 0.138 | −0.110 | 0.880 | −0.480 | 0.464 | 0.880 | 0.989 | −0.412 | 0.880 |
| 0.089 | −0.081 | 0.880 | −0.462 | 0.448 | 0.880 | 1.003 | −0.416 | 0.880 |
| 0.040 | −0.051 | 0.880 | −0.440 | 0.430 | 0.880 | 1.014 | −0.420 | 0.880 |
| −0.008 | −0.020 | 0.880 | −0.416 | 0.410 | 0.880 | 1.020 | −0.426 | 0.880 |
| −0.055 | 0.012 | 0.880 | −0.389 | 0.387 | 0.880 | 1.021 | −0.431 | 0.880 |
| −0.101 | 0.045 | 0.880 | −0.358 | 0.362 | 0.880 | 1.021 | −0.434 | 0.880 |
| −0.147 | 0.079 | 0.880 | −0.325 | 0.335 | 0.880 | 1.021 | −0.435 | 0.880 |
| −0.190 | 0.114 | 0.880 | −0.290 | 0.307 | 0.880 | 1.021 | −0.436 | 0.880 |
| −0.231 | 0.148 | 0.880 | −0.254 | 0.278 | 0.880 | 1.020 | −0.436 | 0.880 |
| −0.270 | 0.181 | 0.880 | −0.215 | 0.248 | 0.880 | | | |
| −0.307 | 0.215 | 0.880 | −0.175 | 0.217 | 0.880 | | | |
| 1.010 | −0.436 | 0.966 | −0.342 | 0.247 | 0.966 | −0.136 | 0.184 | 0.966 |
| 1.009 | −0.437 | 0.966 | −0.374 | 0.279 | 0.966 | −0.093 | 0.152 | 0.966 |
| 1.009 | −0.438 | 0.966 | −0.404 | 0.310 | 0.966 | −0.048 | 0.119 | 0.966 |
| 1.007 | −0.441 | 0.966 | −0.431 | 0.340 | 0.966 | −0.003 | 0.086 | 0.966 |
| 1.004 | −0.444 | 0.966 | −0.454 | 0.367 | 0.966 | 0.043 | 0.055 | 0.966 |
| 0.995 | −0.446 | 0.966 | −0.475 | 0.392 | 0.966 | 0.089 | 0.023 | 0.966 |
| 0.984 | −0.444 | 0.966 | −0.493 | 0.414 | 0.966 | 0.135 | −0.007 | 0.966 |
| 0.970 | −0.440 | 0.966 | −0.508 | 0.433 | 0.966 | 0.182 | −0.037 | 0.966 |
| 0.951 | −0.435 | 0.966 | −0.521 | 0.450 | 0.966 | 0.230 | −0.066 | 0.966 |
| 0.928 | −0.429 | 0.966 | −0.531 | 0.464 | 0.966 | 0.277 | −0.094 | 0.966 |
| 0.900 | −0.421 | 0.966 | −0.540 | 0.476 | 0.966 | 0.325 | −0.122 | 0.966 |
| 0.871 | −0.413 | 0.966 | −0.547 | 0.487 | 0.966 | 0.374 | −0.149 | 0.966 |
| 0.838 | −0.404 | 0.966 | −0.552 | 0.495 | 0.966 | 0.423 | −0.175 | 0.966 |
| 0.802 | −0.393 | 0.966 | −0.555 | 0.502 | 0.966 | 0.472 | −0.201 | 0.966 |
| 0.762 | −0.381 | 0.966 | −0.558 | 0.507 | 0.966 | 0.520 | −0.225 | 0.966 |
| 0.720 | −0.368 | 0.966 | −0.559 | 0.512 | 0.966 | 0.567 | −0.247 | 0.966 |
| 0.677 | −0.354 | 0.966 | −0.559 | 0.516 | 0.966 | 0.612 | −0.269 | 0.966 |
| 0.632 | −0.339 | 0.966 | −0.557 | 0.518 | 0.966 | 0.656 | −0.288 | 0.966 |
| 0.585 | −0.322 | 0.966 | −0.555 | 0.519 | 0.966 | 0.699 | −0.307 | 0.966 |
| 0.537 | −0.304 | 0.966 | −0.551 | 0.519 | 0.966 | 0.740 | −0.324 | 0.966 |
| 0.488 | −0.285 | 0.966 | −0.547 | 0.517 | 0.966 | 0.779 | −0.340 | 0.966 |
| 0.437 | −0.264 | 0.966 | −0.542 | 0.515 | 0.966 | 0.817 | −0.355 | 0.966 |
| 0.385 | −0.241 | 0.966 | −0.536 | 0.511 | 0.966 | 0.852 | −0.369 | 0.966 |
| 0.333 | −0.218 | 0.966 | −0.528 | 0.505 | 0.966 | 0.883 | −0.380 | 0.966 |
| 0.282 | −0.193 | 0.966 | −0.518 | 0.497 | 0.966 | 0.911 | −0.390 | 0.966 |
| 0.231 | −0.168 | 0.966 | −0.507 | 0.488 | 0.966 | 0.938 | −0.399 | 0.966 |
| 0.181 | −0.141 | 0.966 | −0.494 | 0.477 | 0.966 | 0.961 | −0.406 | 0.966 |
| 0.132 | −0.113 | 0.966 | −0.478 | 0.464 | 0.966 | 0.978 | −0.412 | 0.966 |
| 0.083 | −0.084 | 0.966 | −0.460 | 0.448 | 0.966 | 0.993 | −0.416 | 0.966 |
| 0.035 | −0.054 | 0.966 | −0.439 | 0.430 | 0.966 | 1.003 | −0.420 | 0.966 |
| −0.013 | −0.023 | 0.966 | −0.415 | 0.409 | 0.966 | 1.009 | −0.426 | 0.966 |
| −0.059 | 0.010 | 0.966 | −0.388 | 0.387 | 0.966 | 1.010 | −0.430 | 0.966 |
| −0.105 | 0.043 | 0.966 | −0.358 | 0.362 | 0.966 | 1.010 | −0.433 | 0.966 |
| −0.150 | 0.078 | 0.966 | −0.325 | 0.334 | 0.966 | 1.010 | −0.435 | 0.966 |
| −0.193 | 0.112 | 0.966 | −0.290 | 0.306 | 0.966 | 1.010 | −0.435 | 0.966 |
| −0.233 | 0.146 | 0.966 | −0.254 | 0.277 | 0.966 | 1.010 | −0.436 | 0.966 |
| −0.272 | 0.180 | 0.966 | −0.217 | 0.247 | 0.966 | | | |
| −0.308 | 0.214 | 0.966 | −0.177 | 0.216 | 0.966 | | | |
| 0.978 | −0.456 | 1.136 | −0.346 | 0.232 | 1.136 | −0.147 | 0.164 | 1.136 |
| 0.978 | −0.457 | 1.136 | −0.377 | 0.265 | 1.136 | −0.105 | 0.131 | 1.136 |
| 0.977 | −0.458 | 1.136 | −0.405 | 0.298 | 1.136 | −0.062 | 0.097 | 1.136 |
| 0.976 | −0.461 | 1.136 | −0.431 | 0.328 | 1.136 | −0.018 | 0.064 | 1.136 |
| 0.972 | −0.464 | 1.136 | −0.453 | 0.356 | 1.136 | 0.026 | 0.031 | 1.136 |
| 0.964 | −0.466 | 1.136 | −0.473 | 0.381 | 1.136 | 0.071 | −0.001 | 1.136 |
| 0.953 | −0.464 | 1.136 | −0.490 | 0.404 | 1.136 | 0.116 | −0.032 | 1.136 |
| 0.939 | −0.461 | 1.136 | −0.504 | 0.423 | 1.136 | 0.162 | −0.062 | 1.136 |
| 0.920 | −0.456 | 1.136 | −0.516 | 0.440 | 1.136 | 0.208 | −0.092 | 1.136 |
| 0.897 | −0.450 | 1.136 | −0.526 | 0.455 | 1.136 | 0.255 | −0.121 | 1.136 |
| 0.869 | −0.443 | 1.136 | −0.534 | 0.468 | 1.136 | 0.302 | −0.149 | 1.136 |
| 0.840 | −0.436 | 1.136 | −0.540 | 0.478 | 1.136 | 0.349 | −0.176 | 1.136 |
| 0.808 | −0.427 | 1.136 | −0.545 | 0.487 | 1.136 | 0.397 | −0.202 | 1.136 |
| 0.771 | −0.417 | 1.136 | −0.548 | 0.494 | 1.136 | 0.446 | −0.228 | 1.136 |
| 0.732 | −0.406 | 1.136 | −0.550 | 0.499 | 1.136 | 0.493 | −0.252 | 1.136 |
| 0.690 | −0.393 | 1.136 | −0.551 | 0.504 | 1.136 | 0.539 | −0.274 | 1.136 |
| 0.647 | −0.379 | 1.136 | −0.551 | 0.507 | 1.136 | 0.584 | −0.295 | 1.136 |
| 0.603 | −0.364 | 1.136 | −0.549 | 0.510 | 1.136 | 0.628 | −0.315 | 1.136 |
| 0.557 | −0.348 | 1.136 | −0.547 | 0.511 | 1.136 | 0.670 | −0.333 | 1.136 |
| 0.509 | −0.330 | 1.136 | −0.543 | 0.510 | 1.136 | 0.710 | −0.350 | 1.136 |
| 0.461 | −0.311 | 1.136 | −0.539 | 0.509 | 1.136 | 0.749 | −0.365 | 1.136 |
| 0.410 | −0.290 | 1.136 | −0.534 | 0.506 | 1.136 | 0.787 | −0.379 | 1.136 |
| 0.359 | −0.267 | 1.136 | −0.528 | 0.501 | 1.136 | 0.821 | −0.392 | 1.136 |

TABLE I-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.308 | −0.243 | 1.136 | −0.521 | 0.495 | 1.136 | 0.853 | −0.403 | 1.136 |
| 0.258 | −0.218 | 1.136 | −0.512 | 0.488 | 1.136 | 0.880 | −0.412 | 1.136 |
| 0.208 | −0.192 | 1.136 | −0.501 | 0.478 | 1.136 | 0.907 | −0.421 | 1.136 |
| 0.159 | −0.164 | 1.136 | −0.488 | 0.466 | 1.136 | 0.929 | −0.427 | 1.136 |
| 0.111 | −0.136 | 1.136 | −0.473 | 0.453 | 1.136 | 0.947 | −0.433 | 1.136 |
| 0.064 | −0.107 | 1.136 | −0.456 | 0.436 | 1.136 | 0.961 | −0.437 | 1.136 |
| 0.017 | −0.076 | 1.136 | −0.436 | 0.418 | 1.136 | 0.972 | −0.440 | 1.136 |
| −0.029 | −0.044 | 1.136 | −0.413 | 0.397 | 1.136 | 0.977 | −0.446 | 1.136 |
| −0.074 | −0.011 | 1.136 | −0.387 | 0.373 | 1.136 | 0.979 | −0.450 | 1.136 |
| −0.118 | 0.023 | 1.136 | −0.359 | 0.347 | 1.136 | 0.979 | −0.453 | 1.136 |
| −0.162 | 0.058 | 1.136 | −0.328 | 0.319 | 1.136 | 0.979 | −0.455 | 1.136 |
| −0.203 | 0.094 | 1.136 | −0.295 | 0.290 | 1.136 | 0.979 | −0.455 | 1.136 |
| −0.242 | 0.129 | 1.136 | −0.260 | 0.259 | 1.136 | 0.978 | −0.456 | 1.136 |
| −0.279 | 0.164 | 1.136 | −0.224 | 0.228 | 1.136 | | | |
| −0.314 | 0.198 | 1.136 | −0.186 | 0.197 | 1.136 | | | |
| 0.960 | −0.503 | 1.307 | −0.363 | 0.202 | 1.307 | −0.143 | 0.150 | 1.307 |
| 0.960 | −0.503 | 1.307 | −0.391 | 0.239 | 1.307 | −0.103 | 0.115 | 1.307 |
| 0.960 | −0.505 | 1.307 | −0.416 | 0.274 | 1.307 | −0.061 | 0.080 | 1.307 |
| 0.958 | −0.507 | 1.307 | −0.439 | 0.307 | 1.307 | −0.019 | 0.045 | 1.307 |
| 0.955 | −0.511 | 1.307 | −0.459 | 0.338 | 1.307 | 0.024 | 0.010 | 1.307 |
| 0.947 | −0.513 | 1.307 | −0.476 | 0.365 | 1.307 | 0.067 | −0.023 | 1.307 |
| 0.935 | −0.511 | 1.307 | −0.491 | 0.390 | 1.307 | 0.111 | −0.056 | 1.307 |
| 0.920 | −0.508 | 1.307 | −0.503 | 0.411 | 1.307 | 0.155 | −0.089 | 1.307 |
| 0.902 | −0.505 | 1.307 | −0.513 | 0.430 | 1.307 | 0.200 | −0.120 | 1.307 |
| 0.877 | −0.500 | 1.307 | −0.521 | 0.446 | 1.307 | 0.246 | −0.151 | 1.307 |
| 0.849 | −0.494 | 1.307 | −0.528 | 0.460 | 1.307 | 0.291 | −0.181 | 1.307 |
| 0.819 | −0.488 | 1.307 | −0.533 | 0.471 | 1.307 | 0.338 | −0.210 | 1.307 |
| 0.786 | −0.481 | 1.307 | −0.536 | 0.480 | 1.307 | 0.385 | −0.239 | 1.307 |
| 0.748 | −0.472 | 1.307 | −0.538 | 0.488 | 1.307 | 0.432 | −0.266 | 1.307 |
| 0.707 | −0.463 | 1.307 | −0.539 | 0.493 | 1.307 | 0.478 | −0.292 | 1.307 |
| 0.665 | −0.452 | 1.307 | −0.540 | 0.498 | 1.307 | 0.524 | −0.316 | 1.307 |
| 0.621 | −0.439 | 1.307 | −0.539 | 0.502 | 1.307 | 0.568 | −0.339 | 1.307 |
| 0.575 | −0.426 | 1.307 | −0.537 | 0.504 | 1.307 | 0.610 | −0.359 | 1.307 |
| 0.528 | −0.411 | 1.307 | −0.534 | 0.505 | 1.307 | 0.652 | −0.378 | 1.307 |
| 0.479 | −0.394 | 1.307 | −0.530 | 0.505 | 1.307 | 0.692 | −0.396 | 1.307 |
| 0.429 | −0.376 | 1.307 | −0.526 | 0.503 | 1.307 | 0.731 | −0.412 | 1.307 |
| 0.378 | −0.355 | 1.307 | −0.521 | 0.501 | 1.307 | 0.768 | −0.427 | 1.307 |
| 0.326 | −0.333 | 1.307 | −0.515 | 0.497 | 1.307 | 0.803 | −0.440 | 1.307 |
| 0.274 | −0.309 | 1.307 | −0.508 | 0.491 | 1.307 | 0.834 | −0.451 | 1.307 |
| 0.223 | −0.284 | 1.307 | −0.499 | 0.483 | 1.307 | 0.862 | −0.460 | 1.307 |
| 0.173 | −0.257 | 1.307 | −0.488 | 0.473 | 1.307 | 0.888 | −0.468 | 1.307 |
| 0.124 | −0.229 | 1.307 | −0.476 | 0.461 | 1.307 | 0.911 | −0.475 | 1.307 |
| 0.075 | −0.199 | 1.307 | −0.461 | 0.447 | 1.307 | 0.929 | −0.480 | 1.307 |
| 0.028 | −0.167 | 1.307 | −0.444 | 0.431 | 1.307 | 0.943 | −0.483 | 1.307 |
| −0.019 | −0.134 | 1.307 | −0.425 | 0.412 | 1.307 | 0.953 | −0.487 | 1.307 |
| −0.065 | −0.100 | 1.307 | −0.402 | 0.390 | 1.307 | 0.959 | −0.492 | 1.307 |
| −0.109 | −0.064 | 1.307 | −0.377 | 0.366 | 1.307 | 0.961 | −0.497 | 1.307 |
| −0.152 | −0.027 | 1.307 | −0.350 | 0.339 | 1.307 | 0.961 | −0.500 | 1.307 |
| −0.193 | 0.012 | 1.307 | −0.319 | 0.310 | 1.307 | 0.961 | −0.501 | 1.307 |
| −0.232 | 0.050 | 1.307 | −0.287 | 0.280 | 1.307 | 0.961 | −0.502 | 1.307 |
| −0.268 | 0.089 | 1.307 | −0.254 | 0.249 | 1.307 | 0.960 | −0.502 | 1.307 |
| −0.302 | 0.127 | 1.307 | −0.219 | 0.217 | 1.307 | | | |
| −0.334 | 0.165 | 1.307 | −0.182 | 0.184 | 1.307 | | | |
| 0.930 | −0.578 | 1.478 | −0.393 | 0.175 | 1.478 | −0.134 | 0.142 | 1.478 |
| 0.930 | −0.578 | 1.478 | −0.417 | 0.216 | 1.478 | −0.096 | 0.105 | 1.478 |
| 0.929 | −0.580 | 1.478 | −0.438 | 0.255 | 1.478 | −0.056 | 0.067 | 1.478 |
| 0.928 | −0.582 | 1.478 | −0.457 | 0.292 | 1.478 | −0.016 | 0.029 | 1.478 |
| 0.924 | −0.586 | 1.478 | −0.472 | 0.326 | 1.478 | 0.024 | −0.008 | 1.478 |
| 0.916 | −0.589 | 1.478 | −0.486 | 0.356 | 1.478 | 0.065 | −0.045 | 1.478 |
| 0.904 | −0.587 | 1.478 | −0.497 | 0.384 | 1.478 | 0.106 | −0.081 | 1.478 |
| 0.889 | −0.585 | 1.478 | −0.506 | 0.408 | 1.478 | 0.148 | −0.116 | 1.478 |
| 0.869 | −0.582 | 1.478 | −0.512 | 0.428 | 1.478 | 0.191 | −0.151 | 1.478 |
| 0.844 | −0.578 | 1.478 | −0.518 | 0.446 | 1.478 | 0.234 | −0.185 | 1.478 |
| 0.815 | −0.573 | 1.478 | −0.522 | 0.461 | 1.478 | 0.277 | −0.218 | 1.478 |
| 0.784 | −0.569 | 1.478 | −0.524 | 0.474 | 1.478 | 0.321 | −0.251 | 1.478 |
| 0.749 | −0.563 | 1.478 | −0.525 | 0.484 | 1.478 | 0.366 | −0.282 | 1.478 |
| 0.710 | −0.556 | 1.478 | −0.525 | 0.492 | 1.478 | 0.411 | −0.313 | 1.478 |
| 0.668 | −0.547 | 1.478 | −0.524 | 0.498 | 1.478 | 0.456 | −0.342 | 1.478 |
| 0.624 | −0.538 | 1.478 | −0.522 | 0.503 | 1.478 | 0.499 | −0.369 | 1.478 |
| 0.578 | −0.527 | 1.478 | −0.520 | 0.506 | 1.478 | 0.542 | −0.394 | 1.478 |
| 0.531 | −0.514 | 1.478 | −0.518 | 0.508 | 1.478 | 0.583 | −0.418 | 1.478 |
| 0.482 | −0.500 | 1.478 | −0.515 | 0.509 | 1.478 | 0.624 | −0.440 | 1.478 |
| 0.432 | −0.483 | 1.478 | −0.512 | 0.509 | 1.478 | 0.663 | −0.460 | 1.478 |
| 0.381 | −0.465 | 1.478 | −0.507 | 0.508 | 1.478 | 0.701 | −0.479 | 1.478 |
| 0.328 | −0.444 | 1.478 | −0.502 | 0.506 | 1.478 | 0.738 | −0.496 | 1.478 |
| 0.274 | −0.420 | 1.478 | −0.495 | 0.503 | 1.478 | 0.772 | −0.510 | 1.478 |
| 0.221 | −0.395 | 1.478 | −0.487 | 0.498 | 1.478 | 0.803 | −0.523 | 1.478 |

TABLE I-continued

| X-LOC | Y-LOC | Z-LOC | X-LOC | Y-LOC | Z-LOC | X-LOC | Y-LOC | Z-LOC |
|---|---|---|---|---|---|---|---|---|
| 0.169 | −0.367 | 1.478 | −0.478 | 0.490 | 1.478 | 0.831 | −0.533 | 1.478 |
| 0.118 | −0.338 | 1.478 | −0.467 | 0.480 | 1.478 | 0.857 | −0.542 | 1.478 |
| 0.069 | −0.307 | 1.478 | −0.455 | 0.469 | 1.478 | 0.880 | −0.549 | 1.478 |
| 0.021 | −0.274 | 1.478 | −0.440 | 0.454 | 1.478 | 0.898 | −0.554 | 1.478 |
| −0.026 | −0.239 | 1.478 | −0.424 | 0.438 | 1.478 | 0.912 | −0.558 | 1.478 |
| −0.072 | −0.202 | 1.478 | −0.404 | 0.418 | 1.478 | 0.922 | −0.562 | 1.478 |
| −0.116 | −0.164 | 1.478 | −0.382 | 0.396 | 1.478 | 0.928 | −0.567 | 1.478 |
| −0.158 | −0.124 | 1.478 | −0.358 | 0.371 | 1.478 | 0.930 | −0.572 | 1.478 |
| −0.200 | −0.082 | 1.478 | −0.331 | 0.343 | 1.478 | 0.930 | −0.575 | 1.478 |
| −0.239 | −0.038 | 1.478 | −0.302 | 0.312 | 1.478 | 0.930 | −0.576 | 1.478 |
| −0.276 | 0.006 | 1.478 | −0.271 | 0.281 | 1.478 | 0.930 | −0.577 | 1.478 |
| −0.309 | 0.049 | 1.478 | −0.239 | 0.248 | 1.478 | 0.930 | −0.577 | 1.478 |
| −0.339 | 0.092 | 1.478 | −0.206 | 0.214 | 1.478 | | | |
| −0.367 | 0.134 | 1.478 | −0.171 | 0.178 | 1.478 | | | |
| 0.901 | −0.621 | 1.563 | −0.396 | 0.178 | 1.563 | −0.144 | 0.129 | 1.563 |
| 0.901 | −0.621 | 1.563 | −0.417 | 0.221 | 1.563 | −0.108 | 0.090 | 1.563 |
| 0.900 | −0.623 | 1.563 | −0.437 | 0.261 | 1.563 | −0.070 | 0.050 | 1.563 |
| 0.899 | −0.626 | 1.563 | −0.454 | 0.299 | 1.563 | −0.031 | 0.011 | 1.563 |
| 0.895 | −0.629 | 1.563 | −0.468 | 0.334 | 1.563 | 0.008 | −0.029 | 1.563 |
| 0.887 | −0.632 | 1.563 | −0.480 | 0.366 | 1.563 | 0.047 | −0.067 | 1.563 |
| 0.875 | −0.630 | 1.563 | −0.489 | 0.394 | 1.563 | 0.087 | −0.105 | 1.563 |
| 0.860 | −0.628 | 1.563 | −0.497 | 0.418 | 1.563 | 0.128 | −0.142 | 1.563 |
| 0.840 | −0.624 | 1.563 | −0.503 | 0.439 | 1.563 | 0.170 | −0.178 | 1.563 |
| 0.815 | −0.620 | 1.563 | −0.507 | 0.457 | 1.563 | 0.212 | −0.214 | 1.563 |
| 0.785 | −0.616 | 1.563 | −0.510 | 0.472 | 1.563 | 0.255 | −0.249 | 1.563 |
| 0.754 | −0.610 | 1.563 | −0.512 | 0.485 | 1.563 | 0.298 | −0.283 | 1.563 |
| 0.719 | −0.604 | 1.563 | −0.512 | 0.495 | 1.563 | 0.342 | −0.316 | 1.563 |
| 0.680 | −0.597 | 1.563 | −0.512 | 0.503 | 1.563 | 0.387 | −0.348 | 1.563 |
| 0.638 | −0.587 | 1.563 | −0.511 | 0.509 | 1.563 | 0.431 | −0.378 | 1.563 |
| 0.594 | −0.577 | 1.563 | −0.509 | 0.514 | 1.563 | 0.474 | −0.406 | 1.563 |
| 0.548 | −0.565 | 1.563 | −0.507 | 0.517 | 1.563 | 0.517 | −0.432 | 1.563 |
| 0.501 | −0.551 | 1.563 | −0.505 | 0.519 | 1.563 | 0.558 | −0.457 | 1.563 |
| 0.452 | −0.536 | 1.563 | −0.502 | 0.520 | 1.563 | 0.598 | −0.479 | 1.563 |
| 0.403 | −0.518 | 1.563 | −0.498 | 0.520 | 1.563 | 0.637 | −0.500 | 1.563 |
| 0.352 | −0.498 | 1.563 | −0.494 | 0.518 | 1.563 | 0.674 | −0.519 | 1.563 |
| 0.300 | −0.475 | 1.563 | −0.489 | 0.516 | 1.563 | 0.711 | −0.537 | 1.563 |
| 0.246 | −0.450 | 1.563 | −0.483 | 0.512 | 1.563 | 0.744 | −0.552 | 1.563 |
| 0.194 | −0.422 | 1.563 | −0.475 | 0.506 | 1.563 | 0.775 | −0.564 | 1.563 |
| 0.143 | −0.393 | 1.563 | −0.466 | 0.498 | 1.563 | 0.802 | −0.575 | 1.563 |
| 0.093 | −0.361 | 1.563 | −0.456 | 0.487 | 1.563 | 0.828 | −0.585 | 1.563 |
| 0.044 | −0.328 | 1.563 | −0.445 | 0.474 | 1.563 | 0.851 | −0.592 | 1.563 |
| −0.003 | −0.292 | 1.563 | −0.432 | 0.459 | 1.563 | 0.869 | −0.597 | 1.563 |
| −0.048 | −0.255 | 1.563 | −0.416 | 0.441 | 1.563 | 0.883 | −0.601 | 1.563 |
| −0.092 | −0.217 | 1.563 | −0.398 | 0.420 | 1.563 | 0.894 | −0.605 | 1.563 |
| −0.135 | −0.176 | 1.563 | −0.378 | 0.396 | 1.563 | 0.899 | −0.610 | 1.563 |
| −0.176 | −0.134 | 1.563 | −0.355 | 0.370 | 1.563 | 0.901 | −0.615 | 1.563 |
| −0.216 | −0.089 | 1.563 | −0.330 | 0.340 | 1.563 | 0.901 | −0.618 | 1.563 |
| −0.253 | −0.043 | 1.563 | −0.302 | 0.308 | 1.563 | 0.901 | −0.619 | 1.563 |
| −0.287 | 0.002 | 1.563 | −0.273 | 0.275 | 1.563 | 0.901 | −0.620 | 1.563 |
| −0.318 | 0.047 | 1.563 | −0.243 | 0.240 | 1.563 | 0.901 | −0.620 | 1.563 |
| −0.346 | 0.092 | 1.563 | −0.212 | 0.204 | 1.563 | | | |
| −0.372 | 0.136 | 1.563 | −0.179 | 0.167 | 1.563 | | | |

It will also be appreciated that the airfoil disclosed in the above table may be scaled up or down geometrically for use in other similar compressor designs. Consequently, the coordinate values set forth in Table I may be scaled upwardly or downwardly such that the airfoil profile shape remains unchanged. A scaled version of the coordinates in Table I would be represented by X, Y and Z coordinate values multiplied or divided by the same constant or number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator blade for a compressor having an airfoil, the airfoil having a shape in an envelope within ±0.100 inches in a direction normal to any airfoil surface location wherein the airfoil has an uncoated nominal profile substantially in accordance with Cartesian coordinate values of X, Y and Z set forth in inches in Table I wherein the Z coordinate values are perpendicular distances from planes normal to a radius from the compressor centerline and containing the X and Y values with the Z value commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

2. A stator blade according to claim 1, forming part of a tenth stage of a compressor.

3. A blade according to claim 1, wherein the Z=0 value commences at a radial distance of 17.322 inches from the compressor centerline and the Z values are increasingly positive in Table I in a radially outward direction.

4. A stator blade for a compressor having an airfoil, the airfoil having an uncoated nominal airfoil profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

5. A stator blade according to claim 4, forming part of the tenth stage of the compressor.

6. A blade according to claim 4, wherein the Z=0 value commences at a radial distance of 17.322 inches from the compressor centerline and the Z values are increasingly positive in a radially outward direction.

7. A compressor comprising a plurality of stator blades forming a portion of a compressor stage, each of said blades being in the shape of an airfoil within ±0.100 inches in a direction normal to any airfoil surface location wherein the airfoil has an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

8. A compressor according to claim 7, wherein the compressor stage is the tenth stage.

9. A compressor according to claim 7, wherein the Z=0 value commences at a radial distance of 17.322 inches from the compressor centerline and the Z values are increasingly positive in a radially outward direction.

10. A compressor comprising a plurality of stator blades forming a portion of a compressor stage, each of said blades being in the shape of an airfoil within ±0.100 inches in a direction normal to any airfoil surface location wherein the airfoil has an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

11. A compressor according to claim 10, wherein the compressor stage is the tenth stage.

12. A compressor according to claim 10, wherein the Z=0 value commences at a radial distance of 17.322 inches from the compressor centerline and the Z values are increasingly positive in a radially outward direction.

* * * * *